US005707174A

United States Patent [19]

Garren

[11] Patent Number: 5,707,174

[45] Date of Patent: Jan. 13, 1998

[54] UNDERWATER CABLE BURIAL MACHINE USING A SINGLE CABLE FOR TOWING AND LIFTING

[75] Inventor: Donald Lee Garren, Winston-Salem, N.C.

[73] Assignee: AT&T, Middletown, N.J.

[21] Appl. No.: 629,122

[22] Filed: Apr. 8, 1996

[51] Int. Cl.[6] ..... F16L 1/12

[52] U.S. Cl. ..... 405/159; 405/158; 405/154; 405/164; 405/166; 405/180; 294/66.1

[58] Field of Search ..... 405/158, 159, 405/160, 161, 163, 164, 162, 165, 166, 169, 170, 173; 37/313, 312, 345

[56] References Cited

U.S. PATENT DOCUMENTS

| | | | |
|---|---|---|---|
| 3,786,642 | 1/1974 | Good et al. | 405/163 |
| 4,011,727 | 3/1977 | Suzuki et al. . | |
| 4,091,629 | 5/1978 | Gunn et al. | 405/166 |
| 4,129,992 | 12/1978 | Carlsson et al. | 405/164 |
| 4,330,225 | 5/1982 | Glasgow | 405/160 |
| 4,664,553 | 5/1987 | Grinsted et al. | 405/180 |

FOREIGN PATENT DOCUMENTS

| | | | |
|---|---|---|---|
| 2019113 | 10/1979 | United Kingdom | 405/161 |

*Primary Examiner*—Tamara L. Graysay
*Assistant Examiner*—Gary S. Hartmann
*Attorney, Agent, or Firm*—Michele Conover

[57] ABSTRACT

The underwater cable burial machine uses a single cable for both towing and lifting. The machine includes a retractable cable, which is connected between a retraction mechanism and the towing cable. There is a cable guide through which the retractable cable passes. The cable guide is located over the center of gravity of the machine. In order to use the towing cable to lift the machine, the retraction mechanism pulls the retractable cable and the towing cable until the point where the retractable cable and the towing cable meet is at the cable guide. At that point the towing cable will be over the center of gravity of the machine, and the machine can be lifted onto the surface vessel to which the towing cable is attached.

8 Claims, 3 Drawing Sheets

UNDERWATER CABLE BURIAL MACHINE USING A SINGLE CABLE FOR TOWING AND LIFTING

BACKGROUND OF THE INVENTION

The present invention relates to underwater cable burial machines. In particular, the invention relates to an underwater cable burial machine which uses a single cable for both towing and lifting.

Underwater burial machines are used to bury communications cables in the sea bottom in an effort to protect the cables from damage. These machines plow a groove in the seabed beneath a body of water, and they simultaneously lay a cable into the groove which they have plowed. Burial machines use at least one plow blade to cut a groove into the seabed immediately in front of a cable laying mechanism. The cable is then placed into the groove thus formed in order that it will be somewhat beneath the surface of the seabed. After the cable has been laid into the groove, water pressure and underwater currents eventually cause the vertical walls of the groove to collapse and move sand and soil into the groove, thereby covering the cable and assisting in the overall burial operation.

Periodically the burial machines must be returned to the surface for maintenance or for transportation from a site. While it is preferable to be able to minimize the number of cables in the water, in order to avoid damage to the communications cable which is being laid, and to avoid cables becoming entangled, in order to raise the machines of the prior art to the surface, more than one cable has been needed. Alternatively, the machines used complicated schemes by which they could be towed by a combination towing/umbilical cable, and then lifted by that cable when a relatively large yoke was pivoted from the front of the machine (towing position) to the a point above the machine (lifting position). Such arrangements were unwieldy, and they increased the likelihood of damage to or entanglement of the cables or damage to the machine.

In view of the foregoing problems which were not solved by the cable burial machines of the prior art, an improved cable burial machine which uses single cable for both lifting and towing, but which avoided the problems of the prior art would be desirable.

SUMMARY OF THE INVENTION

In accordance with the present invention, a new design approach has been disclosed which solves the problem of being able to both tow and lift a cable burial machine using a single cable. The new design uses a relatively short, strong steel retractable cable which is attached to a retraction mechanism on the cable burial machine. The retractable cable passes through a cable guide which is mounted on the top of the cable burial machine, over the cable burial machine's center of gravity. The other end of the retractable cable is attached to the towing/umbilical cable at a point which is at least as far away from the towing point on the machine as the cable guide is from the towing point. The connection point distance from the towing point is important, in that it will be necessary to retract the connection point to the cable guide, so if the retractable cable is attached any to the towing/umbilical cable, any closer than the towing/umbilical cable is connected to the towing point than it will not be possible to bring the connection point back to the cable guide.

When lifting of the cable burial machine is desired, the retractable cable is pulled back through the cable guide by the retraction mechanism, pulling the towing/umbilical cable with it. When both cables have been withdrawn to the cable guide, the towing/umbilical cable will be over the center of gravity of the cable burial machine, so it can be used to lift the cable burial machine to the surface.

DETAILED DESCRIPTION OF THE PREFERRED EMBODIMENT OF THE INVENTION

Figure 1:
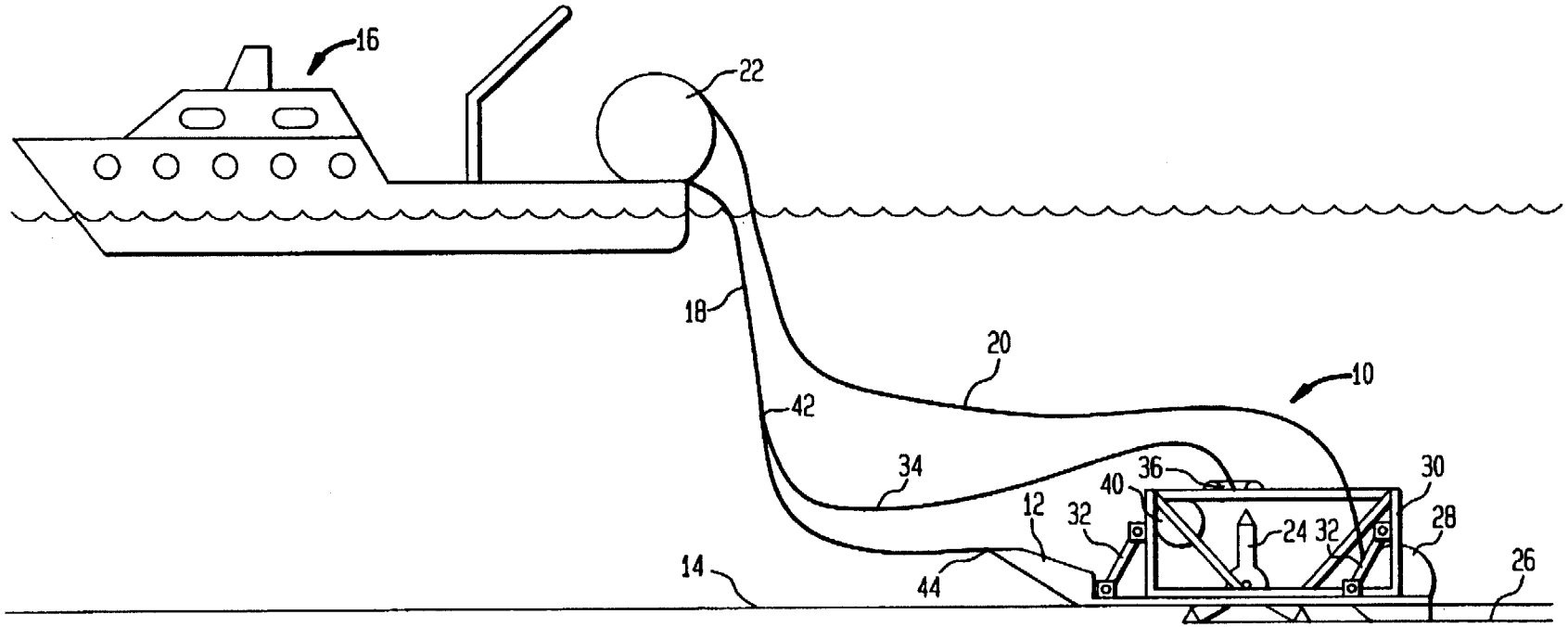
FIG. 1 is a side view illustrating the improved cable laying mechanism of the present invention on a cable burial machine being towed by a surface vessel in a cable laying operation.

Referring to FIG. 1, a simplified side view of a cable laying machine 10 employing the single cable lifting and towing system of the present invention is shown. The cable laying machine 10 is mounted on a sea sled 12 which is being towed along the seabed 14 by a surface vessel 16. The towing is accomplished by means of a combination towing/umbilical cable 18.

During the towing operation, a communications cable 20 is unspooled from a spool 22 on the vessel 16. As the sled 12 is pulled forward, a plow 24 cuts a groove 26 in the seabed 14, and the communications cable 20 is laid into the groove 26 by cable laying apparatus 28 which is located on the rear of a carriage 30 which is fixed to the sled 14 using a four bar linkage 32. As will be understood by those skilled in the art, the four bar linkage 32 allows the carriage 30 to be moved up and down relative to the sled 12. This permits the plow 24 and cable laying apparatus 28, both of which are attached to the carriage 30, and both of which are shown to extend through the flat bottom of the sled 12, to be moved up and down relative to the bottom of the sled 12. The four bar linkage 32 allows the plow 24 and the cable laying apparatus 28 to be moved up above the bottom of the sled 12 when the sled 12 is recovered onto the deck of the vessel 16 for transportation or maintenance. In addition, the four bar linkage 32 can be used to adjust the depth of the groove 26 in the event that that becomes necessary due to the makeup of the seabed 14, i.e., if a rock layer is encountered below the surface of the seabed 14 at a depth which is less than the normal cable laying depth. By way of example, if the normal cable laying depth was twelve inches, and a rock layer was encountered ten inches below the surface of the seabed 14, then the four bar linkage 32 could be adjusted using hydraulic cylinders (not shown) so that the plow teeth only extended somewhat less than ten inches below the seabed 14, thereby preventing damage to the teeth while allowing the burial operation to continue.

As will be understood by those skilled in the art, the combination towing/umbilical cable 18 is used to both tow the sled 12, and to carry hydraulic fluid and electrical signals between the vessel 16 and the sled 12.

With continued reference to FIG. 1, the present invention makes use of a retractable cable 34, a cable guide 36 mounted on top of the carriage 30 at the center of gravity of the burial machine 10, and a retraction mechanism 38 (See FIGS. 3 and 4), which is illustrated by the drum 40, to which one end of the retractable cable 34 is attached.

The other end of retractable cable 34 is attached to the towing/umbilical cable 18 at a point 42 which is at least as far from the towing point 44 on the sled 12 as the towing point 44 is from the cable guide 36.

Figure 2:
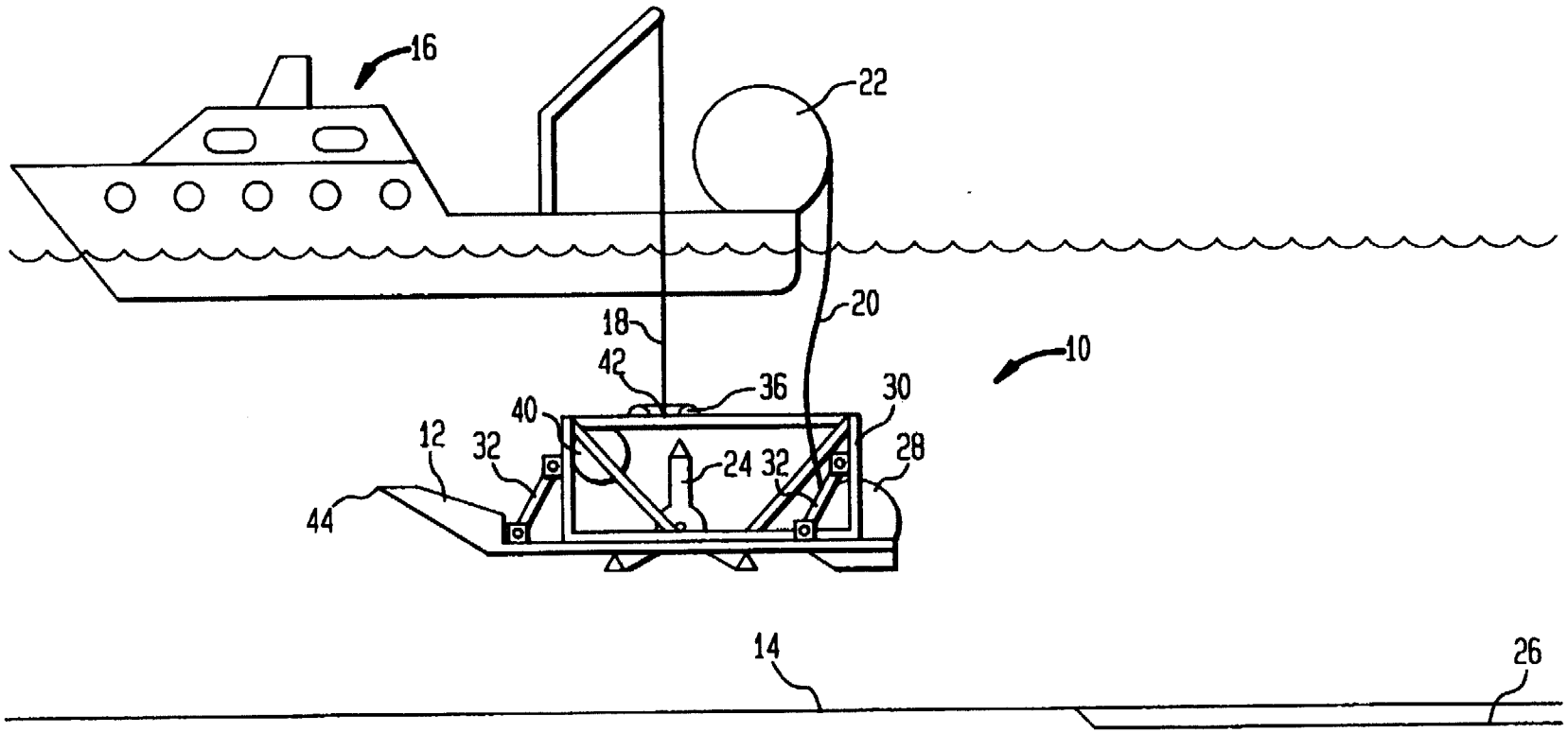
FIG. 2 is a side view illustrating the improved cable laying mechanism of the present invention illustrating the manner in which the towing cable is able to lift the cable burial machine from a point above the center of gravity of the towing machine.

Referring to FIG. 2, when recovery of the sled 10 onto the surface vessel 16 is desired, the retraction mechanism 38 is operated to pull the retractable cable 34, and the attachment point 42 (i.e., where the retractable cable 34 connects to the towing/umbilical cable 18) back to the cable guide 36. When the cables 34, 18 have been pulled back to the cable guide 36, so that the attachment point 42 is at the cable guide 36, the retractable cable 34 will be wound unto the drum 40 (See FIGS. 3 and 4), so it is not visible in FIG. 2. In this position, the towing/umbilical cable 18 can be used to raise the burial machine 10 from above its center of gravity, up to the surface vessel 16. As the lifting of the burial machine 10 will be from above the center of gravity of the burial machine 10, the burial machine 10 will remain horizontal as it is lifted without any need for any type of complicated towing hardware, or without the need for multiple cables extending up to the surface vessel 16. By way of example, for a sled 10 which is on the order of twenty feet long, the retractable cable could be well under one hundred feet long, no matter how deep the cable burying operation is being conducted.

Figure 3:
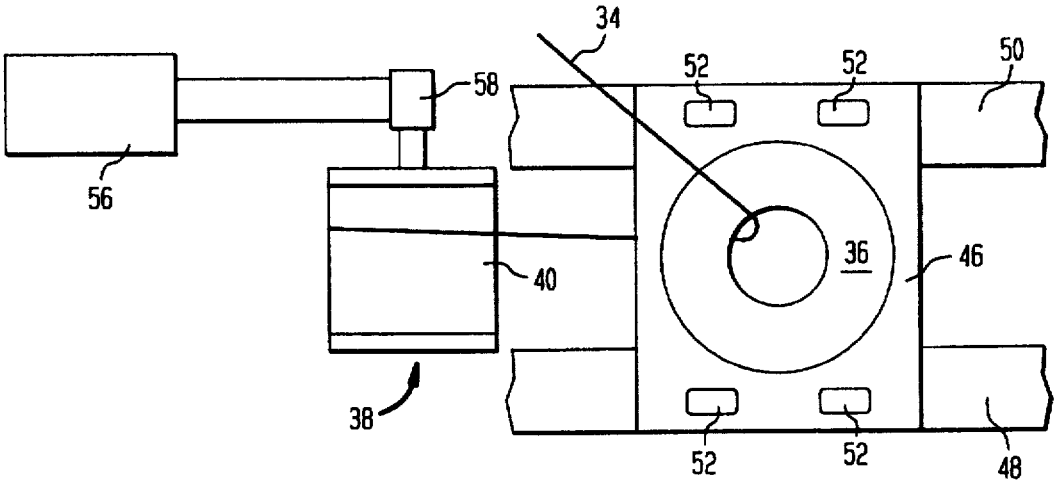
FIG. 3 top view of the retraction mechanism and the cable guide of the present invention.
Figure 4:
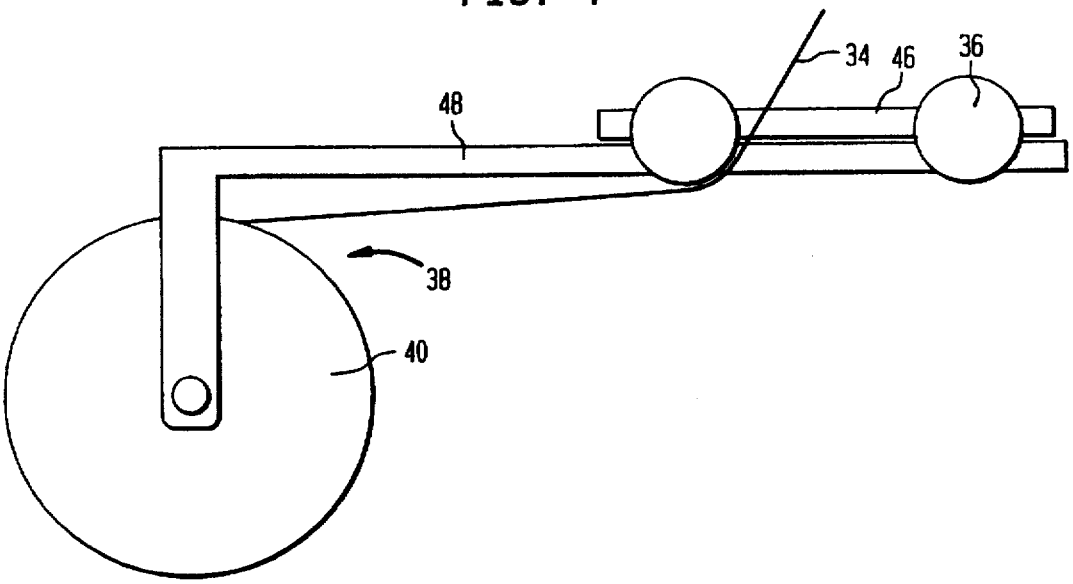
FIG. 4 is a side view of the retraction mechanism and the cable guide of the present invention.

Referring now to FIGS. 3 and 4, the cable guide 36 is shown to be a toroidal structure. While other shapes may be used, it is important that a shape be selected which does not cause chafing to the retractable cable 34, or to the towing/umbilical cable 18.

The cable guide 36 is preferably mounted on a plate 46 which includes means for adjusting its location relative to the carriage 30 (See FIGS. 1 and 2), in order to insure that the cable guide 36 is over the center of gravity of the cable burial machine 10. In the preferred embodiment of the invention, the plate 46 is bolted to arms 48, 50 which are attached to the carriage 30. Accordingly, by changing the location of the bolts (not shown) in the elongated holes 52, the cable guide 36 may be selectively moved over the center of gravity of the cable burial machine 10.

The cable drum 40 which receives and dispenses the retractable cable 34 is also shown in FIGS. 3 and 4, and a motor 56 which is preferably driven by hydraulic means (not shown) is connected to the cable drum 40 by means of an appropriate, reversible drive mechanism 58, which may be a worm gear, a chain chive, or a similar means for transmitting power from the motor 56 to the drum 40. The combination of the drum 40, the motor 56, and the drive mechanism 58, make up the cable retraction mechanism 38, shown in FIGS. 1 and 2.

As will be obvious to those skilled in the art, numerous changes can be made to the preferred embodiment of the invention without departing from the spirit or scope of the invention described herein.

I claim:

1. An underwater cable burial machine which uses a single towing cable for towing and lifting comprises:

(a) a retractable cable;

(b) a cable retraction mechanism mounted on said burial machine, said cable retraction mechanism being attached to said retractable cable;

(c) cable guide means for feeding said retractable cable over the center of gravity of said cable burial machine; and (d) means for attaching the end of said retractable cable which is remote from said cable retraction mechanism to said towing cable.

2. The underwater cable burial machine of claim 1 further comprising means for adjusting the location of said guide means, whereby said guide means may be repositioned over the center of gravity of said machine.

3. The underwater cable burial machine of claim 2 wherein said towing cable is attached to a towing point at the front of said machine, and said retractable cable is attached to said towing cable at a point which is at least as far from said towing point as said cable guide is from said towing point.

4. The underwater cable burial machine of claim 3 wherein said retraction mechanism includes a dram for collecting and dispensing said retractable cable.

5. The underwater cable burial machine of claim 4 wherein said retraction mechanism further comprises a drive motor for reversibly taming said drum to selectively retrieve or dispense said retractable cable.

6. The underwater cable burial machine of claim 5 wherein said motor is hydraulically driven.

7. The underwater cable burial machine of claim 6 wherein said retraction mechanism further comprises a worm gear for transmitting power from said motor to said drum.

8. The underwater cable burial machine of claim 6 wherein said retraction mechanism further comprises a chain drive for transmitting power from said motor to said drum.

* * * * *